United States Patent [19]

Capes et al.

[11] 4,284,413

[45] Aug. 18, 1981

[54] IN-LINE METHOD FOR THE BENEFICIATION OF COAL AND THE FORMATION OF A COAL-IN-OIL COMBUSTIBLE FUEL THEREFROM

[75] Inventors: C. Edward Capes; William L. Thayer, both of Ottawa; Richard D. Coleman, Orleans, all of Canada; Leonard Messer, Coraopolis, Pa.

[73] Assignees: Canadian Patents & Development Ltd., Ottawa, Canada; Leonard Messer, Coraopolis, Pa.

[21] Appl. No.: 105,602

[22] Filed: Dec. 26, 1979

[51] Int. Cl.[3] ..... C10L 1/32

[52] U.S. Cl. ..... 44/51; 44/6; 44/24; 264/117

[58] Field of Search ..... 44/6, 51, 24; 264/117

[56] References Cited

U.S. PATENT DOCUMENTS

| | | | |
|---|---|---|---|
| 3,665,066 | 5/1972 | Capes et al. | 264/117 |
| 4,138,226 | 2/1979 | Verschuur | 44/51 |
| 4,153,419 | 5/1979 | Clayfield et al. | 44/24 |

OTHER PUBLICATIONS

"Pilot Plant Testing of the Spherical Agglomeration Process in Coal Preparation", by Capes et al., presented at the 16th Biennial Conference of The Institute for Briquetting and Agglomeration, San Diego, Aug. 1979.

*Primary Examiner*—Jacqueline V. Howard
*Attorney, Agent, or Firm*—Francis W. Lemon

[57] ABSTRACT

An in-line method for the beneficiation of coal and the formation of a coal-in-oil combustible fuel wherein the coal is wet pulverized, micro-agglomerated with light oil to dissociate a large amount of inorganic impurities and some water, agglomerated with heavy oil to form relatively larger agglomerates and dissociate mainly water with some inorganic impurities, and then mixed with further heavy oil to form the coal-in-oil combustible fuel.

5 Claims, 1 Drawing Figure

Figure 1:
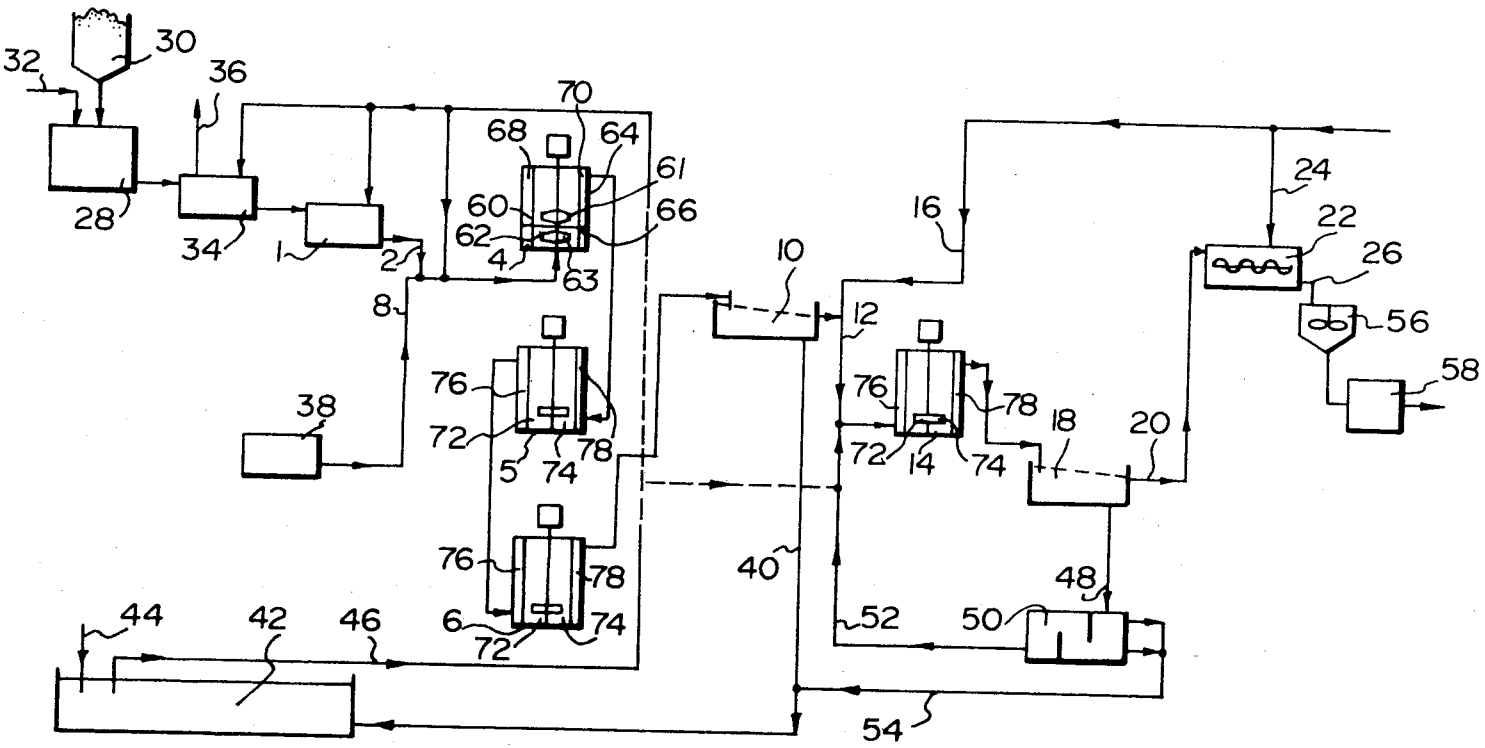

IN-LINE METHOD FOR THE BENEFICIATION OF COAL AND THE FORMATION OF A COAL-IN-OIL COMBUSTIBLE FUEL THEREFROM

This invention relates to an in-line method for the beneficiation of coal and the formation of a coal-in-oil combustible fuel therefrom.

It has already been proposed in U.S. Pat. No. 3,665,066, dated May 23, 1972, "Beneficiation of Coals", Capes et al, to beneficiate a coal slurry effluent by mixing a bridging liquid (light hydrocarbon oil) with coal fines and agitating the formed mixture in an aqueous medium to cause agglomeration of the coal particles. The coal particle agglomerates are then at least partially dewatered and fed to a balling device, together with balling nuclei of relatively coarse coal particles and binding oil (heavy hydrocarbon oil) to form a balled product in which each ball comprises at least one balling nucleus in association with coal particles from the agglomerates. The coal fines may contain significant proportions of hydrophilic (or oleophobic) impurity or ash-forming particles composed of silica, alumina, pyrite, etc. to which the functional groups of the light hydrocarbon oil bridging liquid are incapable of attaching themselves so that when the coal particle agglomerates are formed, these particles remain suspended in the water and are thus effectively separated from the coal particles.

While the process disclosed in the Capes et al patent has proved to be useful for the production of relatively coarse, balled coal products in the range ⅛ inch (3.2 mm) to 1 inch (25.4 mm) which are sufficiently strong to be transported in the balled form without the balls disintegrating or releasing coal dust, there is a need for a process for the production of relatively fine, impurity liberated balled coal products having an average size no greater than of the order of 3 mm in order that the balls will readily disperse in oil to form a combustible fuel comprising a coal-in-oil suspension. Impurity liberated coal-in-oil suspensions would be a useful alternative fuel for existing oil fired electrical generating facilities resulting in a saving in the oil consumption. Other possible uses for these suspensions are marine fuels, fuels for industrial boilers and as injected fuels for blast furnaces.

In Canadian Pat. No. 1,020,880, dated Nov. 15, 1977, "A method of displacing liquid suspendant of a particulate material, liquid suspendant mixture by micro-agglomeration" Capes et al, there is described an in-line, one stage agglomerating process for producing micro-agglomerates of coal fines which is particularly useful for minimizing the moisture content of coal-in-oil suspensions for transportation along long distance pipelines. While this process is useful for the purpose for which it was developed, there is still a need for this process to be developed further to produce a combustible fuel comprising an impurity liberated coal-in-oil suspension wherein more accurate control of and larger amounts of the residual moisture content remaining in the fuel from the original coal-in-water slurry can be achieved. One reason for this may be that the residual moisture content of the coal-in-oil suspension explodes in a combustion chamber and this possibly aids in dispersing the oil and coal and thus in combustion efficiency.

Controlled moisture content could also be useful when the coal-in-oil suspension is subjected to vibratory energy such as, for example, in burners which use vibratory energy to increase the combustion efficiency in combustion chambers.

According to the present invention there is provided an in-line method for the beneficiation of coal and the formation of a coal-in-oil combustible fuel therefrom comprising:

(a) comminuting coal in water to produce a coal-in-water slurry comprising impurity liberated coal particles at least as fine as 40 microns weight mean particle size, then (b) mixing the coal-in-water slurry with light oil agglomerating liquid additive having a specific gravity of less than of the order of 1 g/cm$^3$ to micro-agglomerate the impurity liberated coal particles and primarily dissociate inorganic impurities and some water therefrom, the light oil agglomerating liquid additive being added at not more than of the order of 20 wt % of the total weight of the solids of the coal-in-water slurry, then (c) separating the micro-agglomerated, impurity liberated coal from the dissociated inorganic impurities and water, then (d) mixing the separated, micro-agglomerated, impurity liberated coal with heavy fuel oil, having a specific gravity greater than of the order of 0.9 g/cm$^3$, as agglomerating liquid to produce relatively larger agglomerates comprising an average size no greater than of the order of 3 mm and primarily dissociate water with some inorganic impurities which were present in the micro-agglomerated, impurity liberated coal and leave a residual amount of at least of the order of 5 wt % water in the relatively larger agglomerates, then (e) separating the relatively larger agglomerates from the dissociated water and inorganic impurities, and then (f) mixing the separated, relatively larger agglomerates with make-up heavy oil additive to form a coal-in-oil combustible fuel.

In the accompanying drawing which illustrates, by way of example, an embodiment of the present invention there is shown a flow diagram of an in-line method for the beneficiation of coal and the formation of a coal-in-oil combustible fuel therefrom.

In FIG. 1 there is shown an in-line method for the beneficiation of coal and the formation of a coal-in-oil combustible fuel therefrom, comprising:

(a) comminuting coal-in-water, in a wet mill 1, to produce a coal-in-water slurry 2 comprising impurity liberated coal particles at least as fine as 40 microns weight mean particle size, then (b) mixing the coal-in-water slurry 2, in three stirring devices 4 to 6 arranged in cascade, with light oil 8, having a specific gravity of less than of the order of 1 g/cm$^3$, as agglomerating liquid to micro-agglomerate the impurity liberated coal particles and primarily dissociate inorganic impurities and some water therefrom, the light oil agglomerating liquid 8 being added at not more than of the order of 20 wt % of the total weight of the solids of the coal-in-water slurry 2, then (c) separating, on a dewatering screen 10 the micro-agglomerated, impurity liberated coal from the dissociated inorganic impurities and water, then (d) mixing the separated, micro-agglomerated, impurity liberated coal 12, in a stirrer 14, with heavy fuel oil 16, having a specific gravity greater than of the order of 0.9 g/cm$^3$, as agglomerating liquid to produce relatively larger agglomerates comprising an average size no greater than of the order of 3 mm and primarily dissociate water with some inorganic inpurities which were present in the micro-agglomerated, impurity liberated coal and leave a residual amount of at least of the order of 5 wt % in the relatively larger agglomerates, then (e) separating the relatively larger agglomerates, on a vibrating screen 18, from the dissociated water and inorganic impurities, and then (f) mixing the separated, relatively larger agglomerates 20, in a mixer 22, with make up heavy oil additive 24 to form a coal-in-oil combustible fuel 26.

The dry pulverizer 28 is used for the initial stage of grinding since this will generally pulverize coal faster and in a smaller equipment volume than with wet methods, although wet grinding may be used throughout, if desired. Coal to be pulverized is fed from a storage hopper 30 to the dry pulverizer 28 which is swept with air from a supply 32. The swept air, with entrained pulverized coal, is fed from the pulverizer 28 to a wet scrubber 34. Water containing the pulverized coal is fed from the wet scrubber 34 to the wet mill 1 while air, which has been scrubbed free from the pulverized coal in the wet scrubber 34, is exhausted therefrom at 36.

As previously stated the coal-in-water slurry 2 from the wet mill 1 is stirred in three mixing devices 4 to 6 arranged in cascade. One mixing device could be used provided that the residence time for the coal of the coal-in-water slurry 2 therein to be micro-agglomerated is tolerable. With the embodiment shown in FIG. 1, a residence time of four minutes was required and so the three mixing devices 4 to 6 were provided.

The first mixing device 4 is a high shear mixing device and may be a conventional turbine mixer. The first mixing device 4 is used to disperse the light oil agglomerating liquid 8 in the coal-in-water slurry 2 and give an initial mixing.

The second and third mixing devices, 5 and 6 respectively, are relatively lower blade speed, intermediate intensity mixing devices to the mixing device 4 and are for producing the micro-agglomerates. It should be noted that in different embodiments of the present invention, only one lower, intermediate intensity mixing device is necessary and in other embodiments different mixing devices may be used, such as, for example, one or more emulsifying units with or without one or more lower, intermediate intensity mixing devices.

The light oil agglomerating liquid additive 8 is fed to the first mixing device 4 from a storage tank 38.

As previously stated the micro-agglomerated, impurity liberated coal is separated from the dissociated components comprising primarily inorganic impurities and some water on the screen 10, which in this embodiment is a stationary inclined screen down which the separated, micro-agglomerated, impurity liberated coal rolls and emerges as micro-agglomerates 12 while the dissociated inorganic impurities and water, designated 40, drain through the screen and are conveyed to a settling pond 42. A vibrating screen separator or wet cyclone separator could be used at this stage if the micro-agglomerates possess sufficient strength not to break up in such apparatus.

The embodiment shown in FIG. 1 is arranged to recycle most of the water from delivery 40 to the settling tank 42, together with make-up water 44 which is fed thereto. The water 46 from the settling tank provides feed to the wet scrubber 34, wet mill 1 and the first mixing device 4.

The micro-agglomerates 12 then pass to the mixing device 14 which is also a relatively lower blade speed, intermediate intensity mixing device to the mixing device 4.

The relatively larger agglomerates are separated from the dissociated water and inorganic impurities on the vibrating screen 18 because the relatively larger agglomerates have sufficient strength not to break up on the vibrating screen 18, which is an efficient separator for the purpose. A wet cyclone separator, other types of screens, etc., could also be used at this stage if desired.

The dissociated water and inorganic impurities, designated 48, drain through the vibrating screen 18 and are conveyed to a separation tank 50 from which a portion 52 of the water is returned to the stirrer 14 while the remaining water and inorganic impurities 54 are conveyed to the settling pond 42.

The reason why the water portion 52 is returned to the mixing device 14 is to ensure that sufficient water is delivered, with the relatively larger agglomerates, to the vibrating screen 18 to ensure that the inorganic impurities are thoroughly washed from the relatively larger agglomerates. This substantially reduces the possibility of inorganic impurities being carried over the vibrating screen 18 with the relatively larger agglomerates. In addition, the water in mixing device 14 would usually be heated to about 60° C. to reduce the viscosity of the heavy fuel oil 16. Recirculation of water portion 52 avoids loss of thermal energy in discarded hot water.

The mixer 22, to which the relatively larger agglomerates 20 are conveyed in this embodiment is a stationary, cylindrical vessel having a mixing device rotating about a horizontal axis. Other types of mixers may also be used such as, for example, a paddle type mixer.

The coal-in-oil combustible fuel 26 is stored in an agitated holding tank 56 from which it is withdrawn by a pump 58 at the desired rate for consumption as a combustible fuel in, for example, an electrical power generating installation (not shown). The method can be matched to the desired rate of consumption of the combustible fuel so that the holding tank 56 is merely provided for storage to accommodate any fluctuations in the production of the coal-in-oil combustible fuel or the consumption thereof.

Details of an example using the method shown in FIG. 1 to beneficiate coal mined from Minto, New Brunswick, Canada and to form a coal-in-oil combustible fuel therefrom will now be given.

A typical analysis of the Minto coal is given below which shows that this is a coal having a high ash and sulphur content.

| | Norm | Worst |
|---|---|---|
| Proximate Analysis (as fired) | | |
| Moisture | 6.0% | 12.0% |
| Volatile Matter | 30.0% | 24.2% |
| Fixed Carbon | 46.0% | 33.8% |
| Ash | 18.0% | 30.0% |
| Sulphur | 8.0% | 10.0% |
| Btu/lb. (as fired) | 11,300 | 8,400 |
| (kj/kg) (as fired) | (26,284) | (19,540) |
| Grindability (Hardgrove) | 70 | 60 |
| Ash Fusibility | | |
| Initial deformation, °F. (°C.) | 1,780 (970) | 1,730 (940) |
| Softening, °F. (°C.) | 1,900 (1,040) | 1,850 (1,010) |

-continued

| | Norm | Worst |
|---|---|---|
| Fluid, °F. (°C.) | 1.970 (1,080) | 1,920 (1,050) |

The weight ratio of air to coal fed to the dry pulverizer 28 was in the range 1.5:1 to 2:1. Of the order of 40 wt % coal and 60 wt % water were present in the wet mill 1.

The first mixing device 4 was fed of the order of 20 wt % coal, 3 wt % No. 2 fuel oil and 77 wt % water.

The plant was a pilot plant designed to be capable of treating 100 Imperial gallons/min. (455 l/min.) of slurry 2, which is equivalent to about 6 tons/hour (5.44 tonnes/hour) of coal solids (including impurities) based on the 20 wt % slurry fed to the first mixing device 4.

The blades of the high shear mixing device 4, which were driven by a 5 HP motor at 3,220 rpm, comprised two groups of four high shear impeller blades, two of which are shown for each group and designated 60 to 63, which tapered radially outwardly towards truncated extremities. The high shear impeller blades 60 and 62 were mounted in an 18 inch (0.46 m) internal diameter tank 64 having a 35 inch (0.89 m) height with an annular baffle 66 between the impeller blades 60 and 62 and four vertical baffles, two of which are shown and designated 68 and 70, equally spaced therearound to enhance their shearing effect on the coal-in-water slurry 2.

The four blades of each of the relatively lower blade speed, intermediate intensity mixing devices 5, 6 and 14, which were driven by a 5 HP motor at 280 rpm comprised pitched, turbine impeller blades two of which are shown and designated 72 and 74. The blades 72 and 74 were mounted in a 40 in. (1.02 m) internal diameter vessel having a 40 in. (1.02 m) overflow height with four vertical baffles, two of which are shown and designated 76 and 78, equally spaced around the blades 72 and 74 to enhance their shearing effect.

The dissociated inorganic impurities and water, designated 40, mainly comprised of the order of 96 wt % water and 3 wt % ash and sulphur as the main inorganic impurities together with of the order of 1 wt % unagglomerated combustible matter.

The relatively larger agglomerates produced by mixer 14 comprised of the order of 70 wt % coal, 20 wt % oil and 10 wt % water to which was added sufficient No. 6 fuel oil in the mixer 22 for the coal-in-oil combustible fuel 26 to comprise a coal/oil weight ratio of 40/60.

Tests have shown that using apparatus of the type shown in FIG. 1, then:

(i) the preferred blade tip speed of the high shear impeller blades 60 to 63 is in the range of the order of 10 m/sec. to of the order of 30 m/sec. better still of the order of 20 m/sec. to of the order of 25 m/sec.

(ii) the preferred blade tip speed of the pitched, turbine impeller blades 72 and 74 is up to of the order of 15 m/sec.

Preferred light oils as agglomerating liquid are No. 2 fuel oil and diesel oil. Other light oils as agglomerating liquid are, for example, light petroleum fractions, kerosene, coke oven light oil and light crude and residual and waste oils.

Preferred heavy fuel oils as agglomerating liquid are No. 6 fuel oil and heavy residual oils. Other heavy fuel oils as agglomerating liquid are, for example, crude oils and coke oven tar.

The quantity of light oil agglomerating liquid additive used will depend upon the type of coal being processed and how finely the coal must be ground to produce impurity liberated coal particles. While a greater quantity of light oil agglomerating liquid additive could be used than of the order of 20 wt % of the total weight of solids of the coal-in-water slurry the desirable thing according to the present invention is that only of the order of up to 20 wt % need be used so that the final coal-in-oil combustible fuel will contain, for example, the maximum amount of heavy oil for which an oil fired installation was originally designed, when the coal-in-oil combustible fuel is for use in this manner.

We claim:

1. An in-line method for the beneficiation of coal and the formation of a coal-in-oil combustible fuel therefrom, comprising:

(a) comminuting coal in water to produce a coal-in-water slurry comprising impurity liberated coal particles at least as fine as 40 microns weight mean particle size, then (b) mixing the coal-in-water slurry with light oil as agglomerating liquid having a specific gravity of less than of the order of 1 g/cm$^3$ to micro-agglomerate the impurity liberated coal particles and primarily dissociate inorganic impurities and some water therefrom, the light oil agglomerating liquid being added at not more than of the order of 20 wt % of the total weight of the solids of the coal-in-water slurry, then (c) separating the micro-agglomerated, impurity liberated coal from the dissociated inorganic impurities and water, then (d) mixing the separated, micro-agglomerated, impurity liberated coal with heavy fuel oil, having a specific gravity greater than of the order of 0.9 g/cm$^3$, as agglomerating liquid to produce relatively larger agglomerates comprising an average size no greater than of the order of 3 mm and primarily dissociate water with some inorganic impurities which were present in the micro-agglomerated, impurity liberated coal and leave a residual amount of at least of the order of 5 wt % water in the relatively larger agglomerates, then (e) separating the relatively larger agglomerates from the dissociated water and inorganic impurities, and then (f) mixing the separated, relatively larger agglomerates with make-up heavy oil additive to form a coal-in-oil combustible fuel.

2. A method according to claim 1, wherein the coal is initially pulverized in a dry pulverizer, air is scrubbed free from the dry, pulverized coal in a wet scrubber and then the scrubbed, pulverized coal is comminuted in water to produce the coal-in-water slurry.

3. A method according to claim 1, wherein the coal-in-water slurry is stirred with light oil agglomerating liquid initially in a high shear stirring device, to give an initial mixing, and then in at least one relatively lower blade speed, intermediate intensity mixing device.

4. A method according to claim 1, wherein the light oil as agglomerating liquid is selected from the group consisting of No. 2 fuel oil and diesel oil.

5. A method according to claim 1, wherein the heavy oil as agglomerating liquid is selected from the group consisting of No. 6 fuel oil and heavy residual oils.

* * * * *